US011304491B2

(12) United States Patent
Gomes

(10) Patent No.: US 11,304,491 B2
(45) Date of Patent: Apr. 19, 2022

(54) EFFICIENT CUTICLE BUFFERING TOOL

(71) Applicant: GOMES CONCEPTS LLC, Henderson, NV (US)

(72) Inventor: Barbara Gomes, Margate City, NJ (US)

(73) Assignee: GOMES CONCEPTS LLC, Henderson, NV (US)

( * ) Notice: Subject to any disclaimer, the term of this patent is extended or adjusted under 35 U.S.C. 154(b) by 243 days.

(21) Appl. No.: 16/799,529

(22) Filed: Feb. 24, 2020

(65) Prior Publication Data

US 2020/0187621 A1 Jun. 18, 2020

Related U.S. Application Data

(63) Continuation-in-part of application No. 15/892,754, filed on Feb. 9, 2018, now abandoned.

(60) Provisional application No. 62/492,676, filed on May 1, 2017.

(51) Int. Cl.

| | |
|---|---|
| ***A45D 29/04*** | (2006.01) |
| ***A45D 29/18*** | (2006.01) |
| ***A45D 29/17*** | (2006.01) |
| ***A45D 29/16*** | (2006.01) |

(52) U.S. Cl.
CPC ..... *A45D 29/18* (2013.01); *A45D 29/16* (2013.01); *A45D 29/17* (2013.01)

(58) Field of Classification Search
CPC ..... A45D 29/00; A45D 29/001; A45D 29/05; A45D 29/045; A45D 29/06; A45D 29/11; A45D 29/12; A45D 29/16; A45D 29/17; A45D 29/18; A45D 2200/25
See application file for complete search history.

(56) References Cited

U.S. PATENT DOCUMENTS

| | | | | |
|---|---|---|---|---|
| 1,112,207 A * | 9/1914 | Gibson | A45D 29/04 | 132/75.6 |
| 2,464,374 A * | 3/1949 | Chiego | A45D 29/16 | 132/75.6 |
| 4,765,350 A * | 8/1988 | Moore | A45D 29/06 | 132/319 |
| 4,946,389 A * | 8/1990 | Weissenburger | A61C 17/00 | 433/142 |
| 5,090,427 A | 2/1992 | Sherts | | |
| 5,762,077 A * | 6/1998 | Griffiths, Jr. | A45D 29/007 | 132/318 |
| 6,289,901 B1 * | 9/2001 | Singer | A45D 29/04 | 132/73.5 |

(Continued)

FOREIGN PATENT DOCUMENTS

| | | |
|---|---|---|
| CA | 2949068 A1 | 11/2015 |
| CN | 105639988 A | 6/2016 |

(Continued)

*Primary Examiner* — Rachel R Steitz
(74) *Attorney, Agent, or Firm* — Gearhart Law LLC

(57) ABSTRACT

Cosmetic cuticle apparatuses are presented. A cosmetic cuticle apparatus includes a handle portion having a first end and a second end, two cuticle maintaining devices coupled to the handle portion, and at least one cuticle buffer coupled to at least one side of the two cuticle maintaining devices. The two cuticle maintaining devices include a cuticle pusher having an arcuate periphery and a "V"-shaped cuticle cleaner having a "V"-shaped cross-section.

11 Claims, 7 Drawing Sheets

(56) References Cited

U.S. PATENT DOCUMENTS

| | | | | |
|---|---|---|---|---|
| 8,640,715 | B2 | 2/2014 | Howell | |
| 2008/0078085 | A1* | 4/2008 | Wittke-Kothe | A45D 29/17 30/26 |
| 2012/0255570 | A1 | 10/2012 | Howell | |
| 2013/0125909 | A1 | 5/2013 | Meeks | |
| 2018/0310687 | A1 | 11/2018 | Gomes | |

FOREIGN PATENT DOCUMENTS

| | | | |
|---|---|---|---|
| DE | 3321352 | C2 | 4/1989 |
| DE | 60118253 | T2 | 12/2006 |
| GB | 695060 | A | 8/1953 |
| GB | 2527808 | B | 6/2016 |

* cited by examiner

EFFICIENT CUTICLE BUFFERING TOOL

CROSS-REFERENCE TO RELATED APPLICATIONS

This application is a U.S. Continuation-in-Part Patent Application that claims priority to U.S. Non-Provisional patent application Ser. No. 15/892,754 filed on Feb. 9, 2018, which claims priority from U.S. Provisional Application 62/492,676, filed May 1, 2017, the entire contents of which are hereby incorporated by reference.

FIELD OF THE EMBODIMENTS

This invention relates cosmetic equipment and, in particular, to an efficient cuticle treatment device and a cuticle buffering/grooming apparatus.

BACKGROUND OF THE EMBODIMENTS

Maintaining the health and look of one's fingernails and toenails is a common cosmetic and health-related maintenance. While maintaining ones nails, people typically clean and shape their cuticles. The cuticle is a layer of clear skin located along the bottom edge of ones finger or toe. The cuticle function is to protect new nails from bacteria when they grow out from the nail root. The area around the cuticle is delicate and can get dry, damaged, and/or infected. It's important to care for the entire nail area and keep it clean to ensure the healthiness of ones nails.

As a result, there are a plethora of nail-maintaining devices, each device performing an individual task. This results in bulky cosmetic device containers and/or drawers and increases the difficulty of finding the right device for a specific task. To ease the hassles created from having individual tools for individual functions, an efficient cuticle maintenance tool that performs multiple functions with ease is thus needed. In particular, a singular cuticle treating device that performs multiple functions in the maintenance of cuticles is needed.

Examples of related art are described below:

U.S. Pat. No. 5,090,427 generally describes a finger groomer attachment for a writing instrument. The device performs a variety of manicure operations, and can be used to secure a writing instrument to an item, such as a shirt pocket to protect the writing part of a writing instrument from damage and to protect against unwanted marks made by an unprotected writing point while at the same time guarding against fouling of the instrument. The inventive device incorporates a fingernail cleaner for cleaning under fingernails, a pocket-clip for attaching a writing instrument to an item such as a shirt pocket, a cuticle pusher for pushing back the cuticle of a finger, and an abrasive strip for shaping of the fingernails. These are conveniently incorporated into a durable and easy to manufacture attachment which fits on a variety of writing instruments.

U.S. Pat. No. 8,640,715 generally describes a nail care apparatus. In one embodiment, a nail care apparatus comprises a housing, a blade extending from the housing to a distal end, a motor disposed in the housing and operatively driving the blade to reciprocate in two parallel planes, and a power source providing power to the motor. The distal end of the blade may narrow to a peaked distal edge.

U.S. patent application No. 2013/0125909 generally describes a manicurist tool comprising a body, a first end, and a second end, the body comprising one or more gel pads integral with the body, the gel pads having a shape adapted to promote an optimal ergonomic position for fingers of a user of the manicurist tool, the first end comprising an attached cuticle pushing tip comprising flexible sides, the cuticle pushing tip attached to a spring assembly removably attached to the body, the cuticle pushing tip constructed of a polymeric material.

British Patent No. GB695060A generally describes improvements for scissor guards, the scissor guards being applicable for use with scissors generally for protecting the points when not in use and protecting the pocket, handbag or other container against damage by the points when the scissors are carried therein.

British Patent No. GB2527808B generally describes a manicure or pedicure device that includes an elongate body having at least one longitudinally curved surface on which a curved nail treatment surface is provided, wherein the body comprises first and second parts, the first part providing a cavity and the second part being attachable to the first part to close said cavity and being separable from the first part, wherein a personal care tool is at least partially located in the cavity when the first and second parts are attached together, wherein the curved nail treatment surface is provided at least on the second part.

Canadian patent No. 2,949,068 generally describes a nail file case of the kind having a generally clam shell type configuration is described, with an upper lid and a lower base, the lid being connected to the base by a flexible hinge. The case further includes a slot extending along an upper surface of the lid, the slot being sized to receive a fingernail tip therethrough. A cuticle pusher also is formed on the case, the cuticle pusher including a blade being configured for pushing a cuticle of a fingernail. In addition, a nail cleaner is formed on the case, the nail cleaner including a projection extending from the case being configured for insertion beneath a fingernail for scraping out dirt lodged thereunder.

Chinese Patent Publication No. CN105639988A generally describes a disposable manicure tool. The disposable manicure tool comprises an elongate carrier element having abrasive inserts and at least one stop for the user's hand. One end of the carrier element is a scraper in the form of a knife blade with a sharpened cutting edge, and the other is a pusher in the form of a blade with an end working edge for moving away the cuticle. The scraper and the pusher, together with the carrier element are one-piece plastic product. The cross section of the carrier element has a rectangular shape which width is at least 0.5 of its height. The abrasive inserts are arranged on the carrier element in an arbitrary combination with the said stops for the thumb of the user. The stop on the pusher is placed on one its side or on both its sides. The abrasive insert is a strip of abrasive material deposited on the carrier element. Covering strips of the scarper and the pusher can be provided with flat surfaces which are firmly fixed to the covering strips by a bonding material, and the covering strips can be manufactured into projections, embedded into the body of the carrier element, of various shapes. The tail end of the covering strip of the scraper can turn upwards to a cutting edge when an acute angle is formed between the tail end and a tool longitudinal axis.

German Patent No. DE3321352C2 generally describes a device for manicure, composed of a one-piece, elongated holder with an up to the ends conducted longitudinal groove into which a file usable on both sides can be inserted.

German Patent No. DE60118253T2 generally describes a tool with multiple functions, particularly with cutting and cleaning capabilities for cuticles and nails, which allow users to have a series of functions in a single, small-sized device.

None of the art described above addresses all of the issues that the present invention does.

SUMMARY OF THE EMBODIMENTS

According to an aspect of the present invention, a cosmetic cuticle apparatus is presented. The cosmetic cuticle apparatus includes a handle portion, at least one cuticle maintaining device coupled to the handle portion, and a cuticle buffer coupled to at least one side of the at least one cuticle maintaining device.

According to another aspect of the present invention, a cosmetic cuticle apparatus is presented. The cosmetic cuticle apparatus includes a handle portion, a cuticle pusher coupled to the handle portion, a cuticle cleaner coupled to the handle portion, a first cuticle buffer coupled to one side of the cuticle pusher, and a second cuticle buffer coupled to one side of the cuticle cleaner.

It is an object of the present invention to provide the cosmetic cuticle apparatus, where the at least one cuticle maintaining device is selected from the group consisting of a cuticle pusher, a cuticle buffer, and a cuticle cleaner.

It is an object of the present invention to provide a scissor-free device for treating cuticles.

It is an object of the present invention to provide the cosmetic cuticle apparatus, where the cuticle buffer is removably coupled to the at least one cuticle maintaining device.

It is an object of the present invention to provide the cosmetic cuticle apparatus, where the cuticle buffer is etched into the at least one cuticle maintaining device.

It is an object of the present invention to provide the cosmetic cuticle apparatus, where the cuticle buffer is coupled to the handle portion.

It is an object of the present invention to provide the cosmetic cuticle apparatus, where the cuticle buffer is removably coupled to the handle portion.

It is an object of the present invention to provide the cosmetic cuticle apparatus, where the cuticle buffer is etched into the handle portion.

It is an object of the present invention to provide the cosmetic cuticle apparatus, where the at least one cuticle maintaining device and the handle portion are a singular structure.

It is an object of the present invention to provide the cosmetic cuticle apparatus, where the first cuticle buffer is removably coupled to the cuticle pusher.

It is an object of the present invention to provide the cosmetic cuticle apparatus, where the second cuticle buffer is removably coupled to the cuticle cleaner.

It is an object of the present invention to provide the cosmetic cuticle apparatus, where the first cuticle buffer is etched into the cuticle pusher.

It is an object of the present invention to provide the cosmetic cuticle apparatus, where the second cuticle buffer is etched into the cuticle cleaner.

It is an object of the present invention to provide the cosmetic cuticle apparatus, where the first or the second cuticle buffer is coupled to the handle portion.

It is an object of the present invention to provide the cosmetic cuticle apparatus, where the first or the second cuticle buffer is removably coupled to the handle portion.

It is an object of the present invention to provide the cosmetic cuticle apparatus, where the first or the second cuticle buffer is etched into the handle portion.

It is an object of the present invention to provide the cosmetic cuticle apparatus, where the cuticle pusher, the cuticle cleaner, and the handle portion are a singular structure.

DESCRIPTION OF THE PREFERRED EMBODIMENTS

Figure 1:
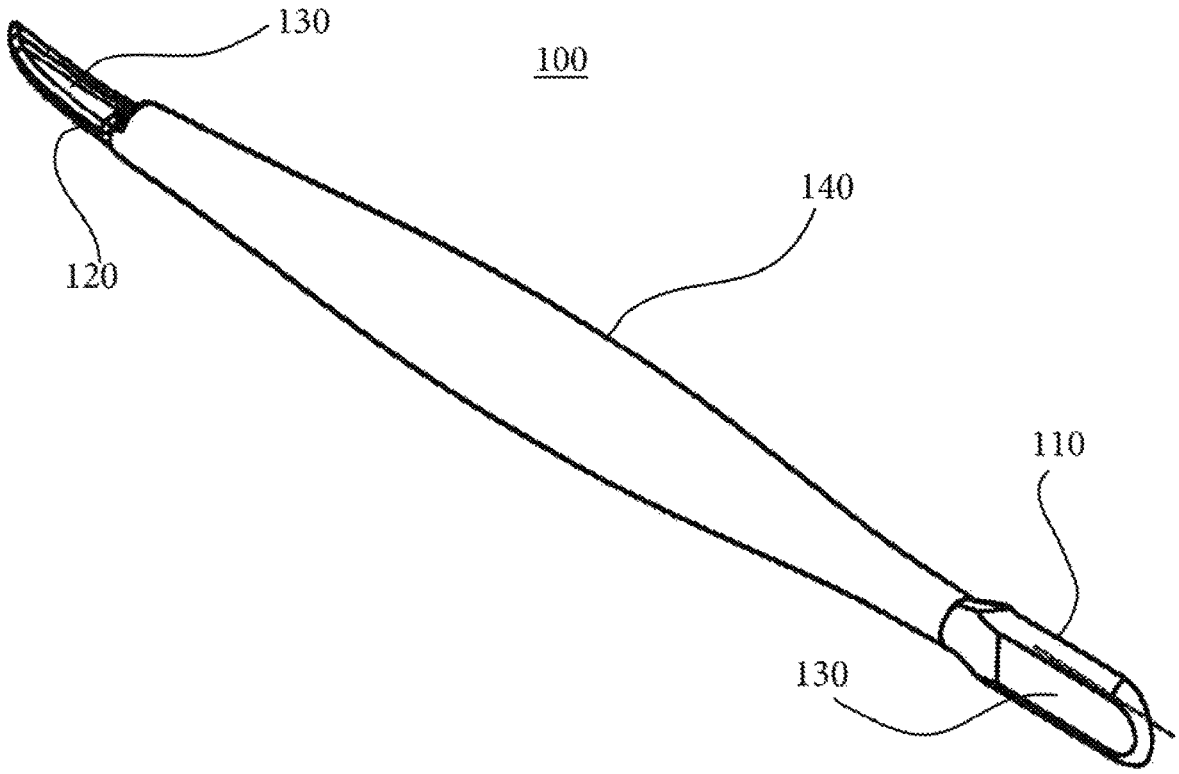
FIG. 1 shows a perspective view of an efficient cuticle tool having a cuticle buffer and a cuticle cleaner, according to an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, a perspective view of an efficient cuticle tool 100 having a cuticle pusher 110 and a cuticle cleaner 120 is depicted, in accordance with an embodiment of the present invention. It should be appreciated that the efficient cuticle tool 100 is a scissor-free device used to treat cuticles. The cuticle pusher 110 may have an arcuate periphery. In examples, the cuticle pusher 110 has at least one protruding convex edge. In other examples, the cuticle pusher 110 may include a combination of the cuticle pusher 110 and a cuticle buffer 130. In further examples, the cuticle buffer 130 may be a nail file. It is further noted that the cuticle cleaner 120 may include a combination of the cuticle cleaner 120 and the cuticle buffer 130. In examples, the cuticle cleaner 120 may be V-shaped having a pointed top and a V-shaped cross-section.

According to another embodiment, the efficient cuticle tool 100 includes either one or more cuticle pushers 110 and/or one or more cuticle cleaners 120. The efficient cuticle tool 100 has a handle portion 140. The handle portion 140 has a first end disposed opposite a second end. In examples, the handle portion 140 is elongated and has a generally circular cross-section. The elongated handle portion 140 has a thickness that is greater at a middle portion than at either the first or the second end. The one or more cuticle pushers 110 and/or one or more cuticle cleaners 120 are secured to an end of the handle portion 140.

It should be appreciated that a cuticle maintaining device may include the cuticle pusher 110, the cuticle buffer 130, or the cuticle cleaner 120. In some examples, one cuticle maintaining device (e.g., the cuticle pusher 110, the cuticle buffer 130, or the cuticle cleaner 120) is coupled to the handle portion 140 of the efficient cuticle tool 100.

In other examples, two cuticle maintaining devices (e.g., the cuticle pusher 110, the cuticle buffer 130, or the cuticle cleaner 120) are coupled to the handle portion 140 of the efficient cuticle tool 100. In this example, the two cuticle maintaining devices include the cuticle pusher 110 and the cuticle cleaner 120. In this example, the cuticle pusher 110 may be coupled to the first end of the handle portion 140 and the cuticle cleaner 120 may be coupled to the second end of the handle portion 140.

An illustrative example of the efficient cuticle tool 100 includes a handle portion 140 that is elongated and has a circular cross-section, as well as the first end disposed opposite the second end. The handle portion 140 has a thickness that is greater at a middle portion than at either the first end or the second end. The handle portion 140 flares outward to a point at each of the first end and the second end. A frustoconical portion is formed from the point to a terminal portion of the first end and the second end, forming a receptacle on each of the first end and the second end of the handle portion 140.

In this illustrative example, the efficient cuticle tool 100 also includes the cuticle pusher 110 coupled to the receptacle at the first end of the handle portion 140. The cuticle pusher 110 has a top surface and an arcuate periphery. A width of the top surface of the cuticle pusher 110 is less than a width of the arcuate periphery of the cuticle pusher 110. In additional examples, the underside of the cuticle pusher 110 is flat. In other examples, the cuticle pusher 110 has a sloped surface coupling the arcuate periphery to the top surface. The efficient cuticle tool 100 may also include the cuticle buffer 130 disposed on the top surface of the cuticle pusher 110. In additional examples, the cuticle buffer 130 is removable.

In accordance with this illustration, the efficient cuticle tool 100 may also include the cuticle cleaner 120. In examples, the cuticle pusher 110 and the cuticle cleaner 120 are threadably coupled to the handle portion 140. In other examples, the cuticle pusher 110 and the cuticle cleaner 120 are removably coupled by threading to the handle portion 140. The cuticle cleaner 120 may be V-shaped, having a pointed top and a V-shaped cross-section. In further examples, the pointed top of the cuticle cleaner 120 is oriented to align with a top side of the handle portion 140. The cuticle cleaner 120 may be coupled to the receptacle at the second end of the handle portion 140. It should be appreciated that this example was for illustration purposes only and other example configurations are contemplated.

Figure 2:
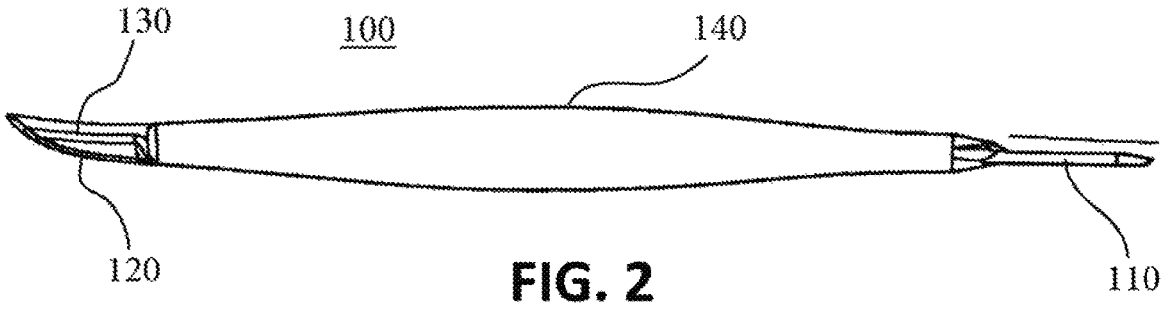
FIG. 2 shows a side view of an efficient cuticle tool having a cuticle buffer and a cuticle cleaner, according to an embodiment of the present invention.
Figure 3:
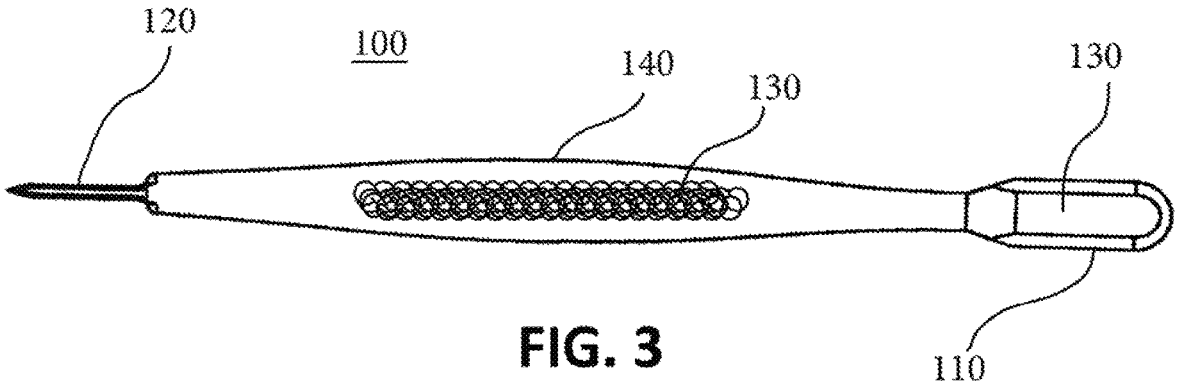
FIG. 3 shows a top view of an efficient cuticle tool having a cuticle buffer and a cuticle cleaner, according to an embodiment of the present invention.
Figure 4:
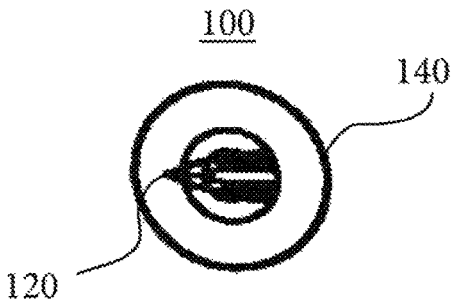
FIG. 4 shows a front view of an efficient cuticle tool having a cuticle buffer and a cuticle cleaner, according to an embodiment of the present invention.
Figure 5:
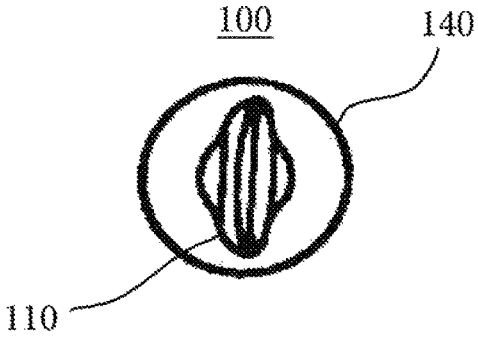
FIG. 5 shows a rear view of an efficient cuticle tool having a cuticle buffer and a cuticle cleaner, according to an embodiment of the present invention.

Referring now to FIGS. 2-3, a side view (FIG. 2) and a top view (FIG. 3) of an efficient cuticle tool 100 having the cuticle pusher 110 and the cuticle cleaner 120 are illustratively depicted, in accordance with an embodiment of the present invention.

According to an embodiment, the efficient cuticle tool 100 includes the cuticle buffer 130. According to an embodiment, the cuticle buffer 130 is coupled to the cuticle pusher 110. The cuticle buffer 130 may be coupled to the cuticle pusher 110 by way of an adhesive, a clip, a hook and loop fastener, and/or any other suitable fastening mechanism while maintaining the spirit of the present invention. According to an embodiment, the cuticle buffer 130 is removably coupled to the cuticle pusher 110.

According to an embodiment, the cuticle buffer 130 is etched into the cuticle pusher 110. The cuticle buffer 130 may encompass a part or an entire surface of a side of the cuticle pusher 110. The cuticle buffer 130 may encompass one or multiple sides of the cuticle pusher 110. According to an embodiment, one side of the cuticle pusher 110 contains no cuticle buffer 130. According to an embodiment, the cuticle pusher 110 is spade-shaped.

In other examples, and as explained supra, the cuticle pusher 110 may have a top surface and an arcuate periphery. A width of the top surface of the cuticle pusher 110 is less than a width of the arcuate periphery of the cuticle pusher 110. In additional examples, the underside of the cuticle pusher 110 is flat. In other examples, the cuticle pusher 110 has a sloped surface coupling the arcuate periphery to the top surface. It is noted, however, that the cuticle pusher 110 may include other suitable shapes while maintaining the spirit of the present invention.

According to an embodiment, the cuticle buffer 130 is coupled to the cuticle cleaner 120. The cuticle buffer 130 may be coupled to the cuticle cleaner 120 by way of an adhesive, a clip, a hook and loop fastener, and/or any other suitable fastening mechanism while maintaining the spirit of the present invention. According to an embodiment, the cuticle buffer 130 is removably coupled to the cuticle cleaner 120. According to an embodiment, the cuticle buffer 130 is etched into the cuticle cleaner 120. The cuticle buffer 130 may encompass a part or an entire surface of a side of the cuticle cleaner 120. The cuticle buffer 130 may encompass one or multiple sides of the cuticle cleaner 120.

As shown in the embodiment of FIG. 3, one side of the cuticle cleaner 120 contains no cuticle buffer 130. According to an embodiment, the cuticle cleaner 120 is spear-shaped. It is noted, however, that the cuticle cleaner 120 may include other suitable shapes while maintaining the spirit of the present invention. For example, according to FIGS. 8-11, the cuticle cleaner 120 is V-shaped, having a pointed top and a V-shaped cross-section. In further examples, the pointed top of the cuticle cleaner 120 is oriented to align with a top side of the handle portion 140. Further, each of the cuticle pusher 110 or the cuticle cleaner 120 may have varying shapes and possess varying degrees of bluntness or sharpness depending on the desired characteristics.

According to an embodiment, the cuticle buffer 130 is coupled to the handle portion 140. The cuticle buffer 130 may be coupled to a part or an entire surface of the handle portion 140. According to an embodiment, the cuticle buffer 130 is etched into the handle portion 140. The cuticle buffer 130 may cover all or part of the surface area of the handle portion 140. According to an embodiment, the at least one cuticle pusher 110 and/or at least one cuticle cleaner 120 and the handle portion 140 are a singular device.

Figure 6:
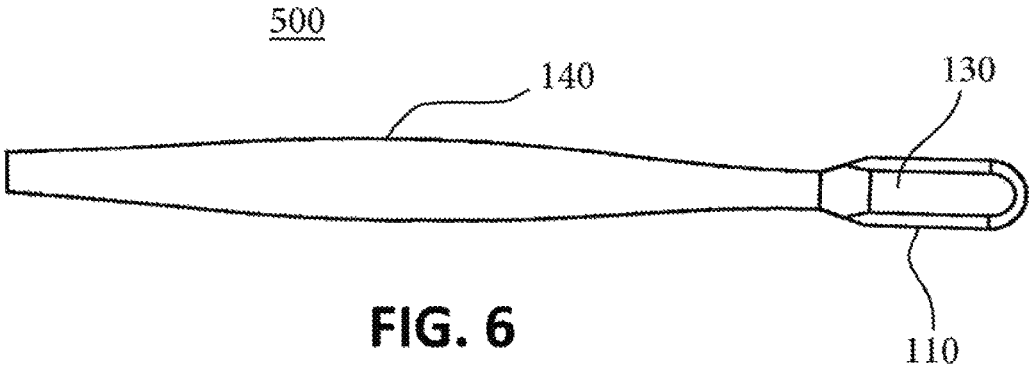
FIG. 6 shows a perspective view of an efficient cuticle tool having a cuticle buffer, according to an embodiment of the present invention.
Figure 7:
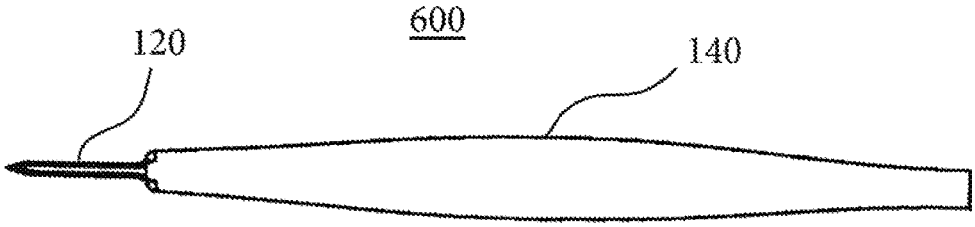
FIG. 7 shows a perspective view of an efficient cuticle tool having a cuticle cleaner, according to an embodiment of the present invention.
Figure 8:
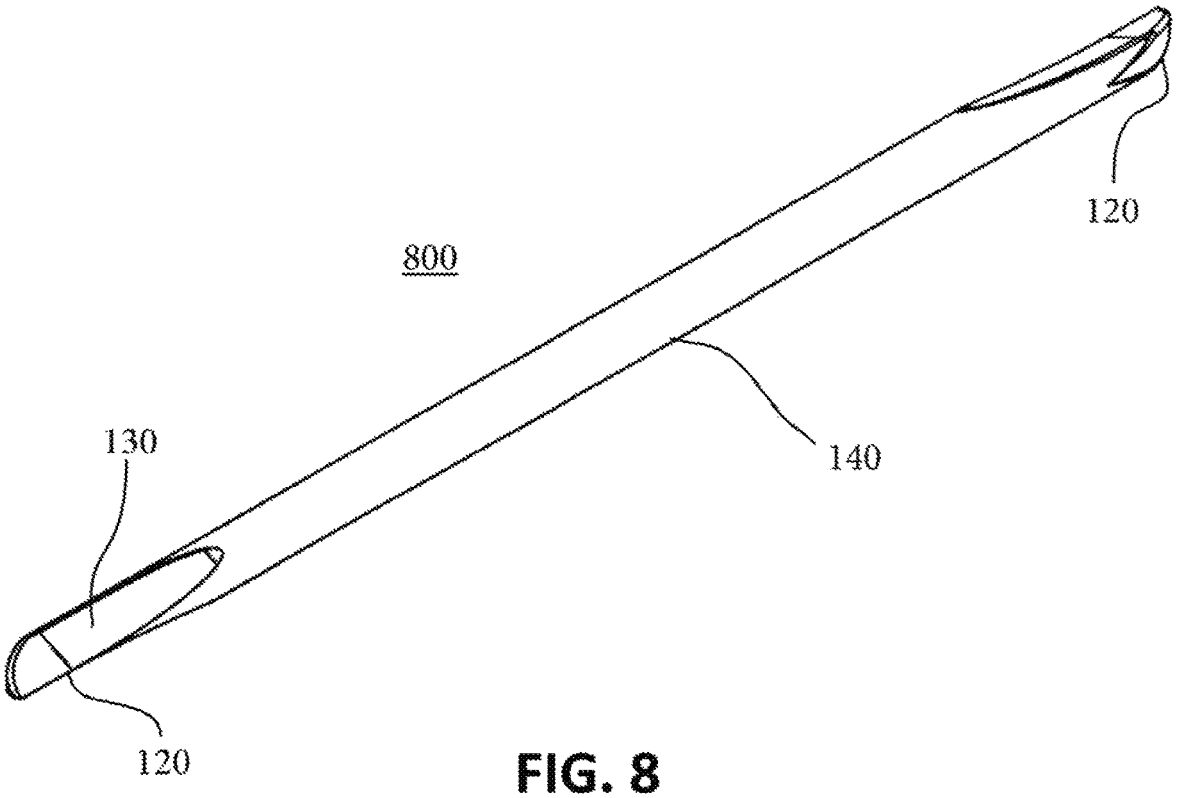
FIG. 8 shows a perspective view of an efficient cuticle tool having two cuticle buffers or cleaners, according to an embodiment of the present invention.
Figure 9:
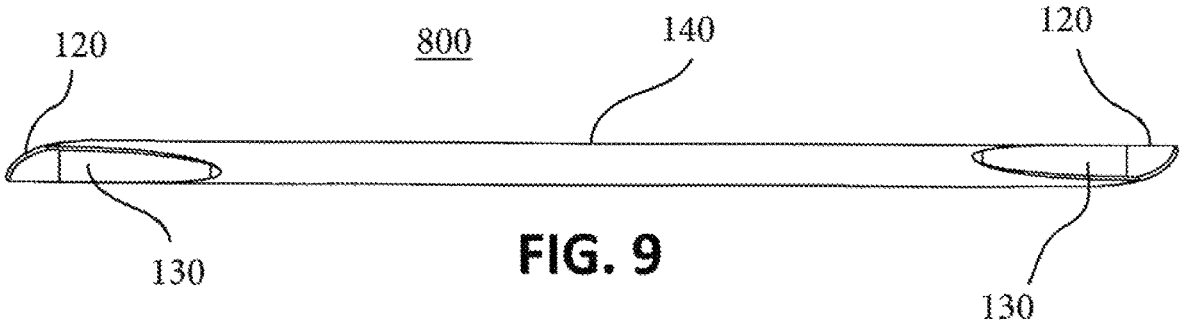
FIG. 9 shows a side view of an efficient cuticle tool having two cuticle buffers or cleaners, according to an embodiment of the present invention.
Figure 10:
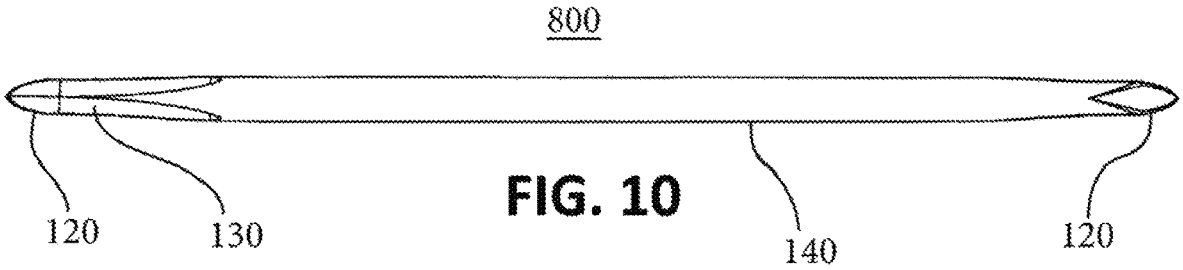
FIG. 10 shows a bottom view of an efficient cuticle tool having two cuticle buffers or cleaners, according to an embodiment of the present invention.
Figure 11:
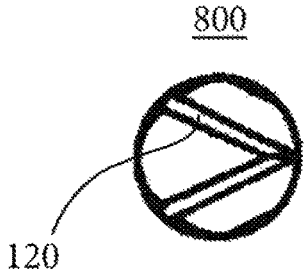
FIG. 11 shows a front view of an efficient cuticle tool having two cuticle buffers or cleaners, according to an embodiment of the present invention.

Referring now to FIGS. 6-7, perspective views of an efficient cuticle tool 400 having only a cuticle pusher 110 (FIG. 6) and an efficient cuticle tool 500 having only a cuticle cleaner 120 (FIG. 7) are illustratively depicted, in accordance with various embodiments of the present invention.

According to various embodiments, the cuticle pusher 110 of efficient cuticle tool 400 and the cuticle cleaner 120 of efficient cuticle tool 500 are configured similarly to the cuticle pusher 110 and cuticle cleaner 120 of efficient cuticle tool 100.

According to an embodiment, the cuticle pusher 110 has a curved surface. According to an embodiment, the cuticle pusher 110 has a flat surface. In further examples, the cuticle pusher 110 has a top surface and an arcuate periphery. A width of the top surface of the cuticle pusher 110 is less than a width of the arcuate periphery of the cuticle pusher 110. In additional examples, the underside of the cuticle pusher 110 is flat. In other examples, the cuticle pusher 110 has a sloped surface coupling the arcuate periphery to the top surface. It is noted, however, that the cuticle pusher 110 and cuticle cleaner 120 may include other suitable shapes while maintaining the spirit of the present invention.

According to an embodiment, the cuticle buffer 130 may be coupled to the cuticle pusher 110 on one the surfaces, both of the surfaces, and/or on the edge between the two surfaces. As shown in FIGS. 3-4 and FIGS. 7-11, the cuticle cleaner 120 may have a pointed top for aiding in cleaning cuticles.

As shown in FIGS. 8-11, an efficient cuticle tool 800 having a cuticle cleaner 120 on both ends of a handle portion 140 is illustratively depicted, in accordance with an embodiment of the present invention. According to an embodiment, there is a cuticle buffer 130 coupled to one of the two cuticle cleaners 120. According to another embodiment, the cuticle buffer 130 is coupled to both of the cuticle cleaners 120.

Figure 12:
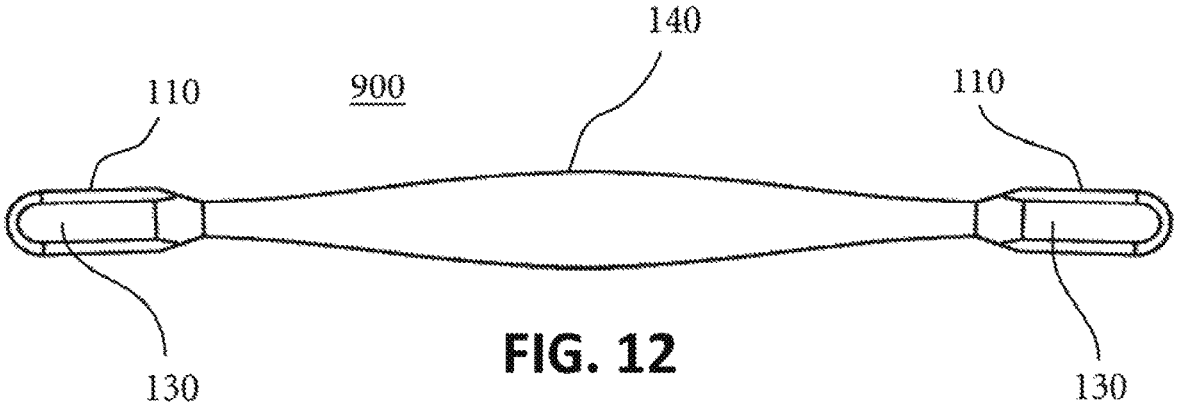
FIG. 12 shows a side view of an efficient cuticle tool having two cuticle buffers or pushers, according to an embodiment of the present invention.

As shown in FIG. 12, an efficient cuticle tool 900 is shown having a cuticle pusher 110 on both ends of a handle portion 140. According to an embodiment, there is a cuticle buffer 130 coupled to one of the two cuticle pushers 110. According to another embodiment, the cuticle buffer 130 is coupled to both of the cuticle pushers 110.

Figure 13:
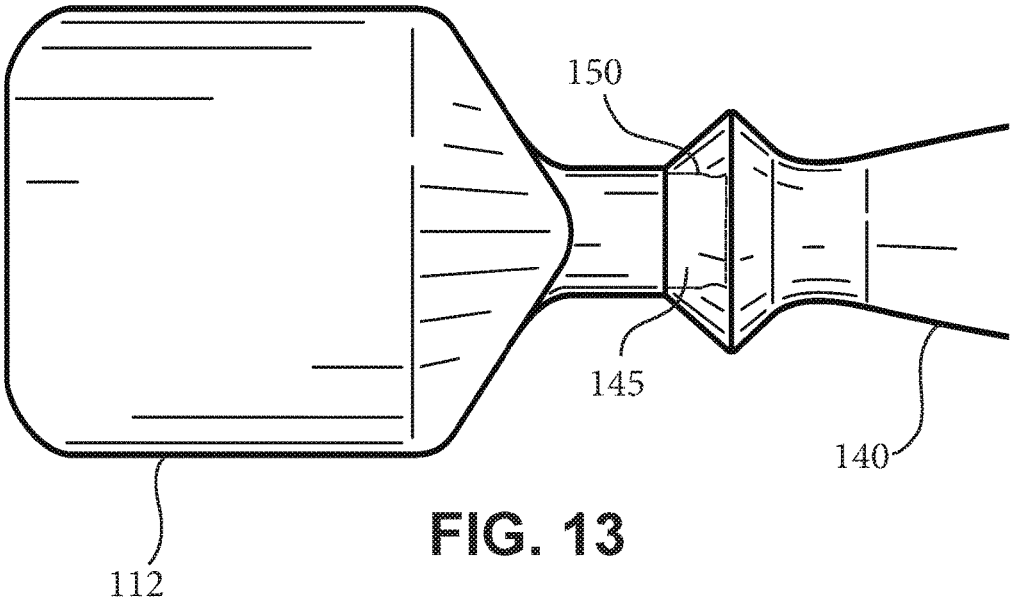
FIG. 13 shows a side view of a portion of an efficient cuticle tool having a removable cuticle-pusher, according to an embodiment of the present invention.
Figure 14:
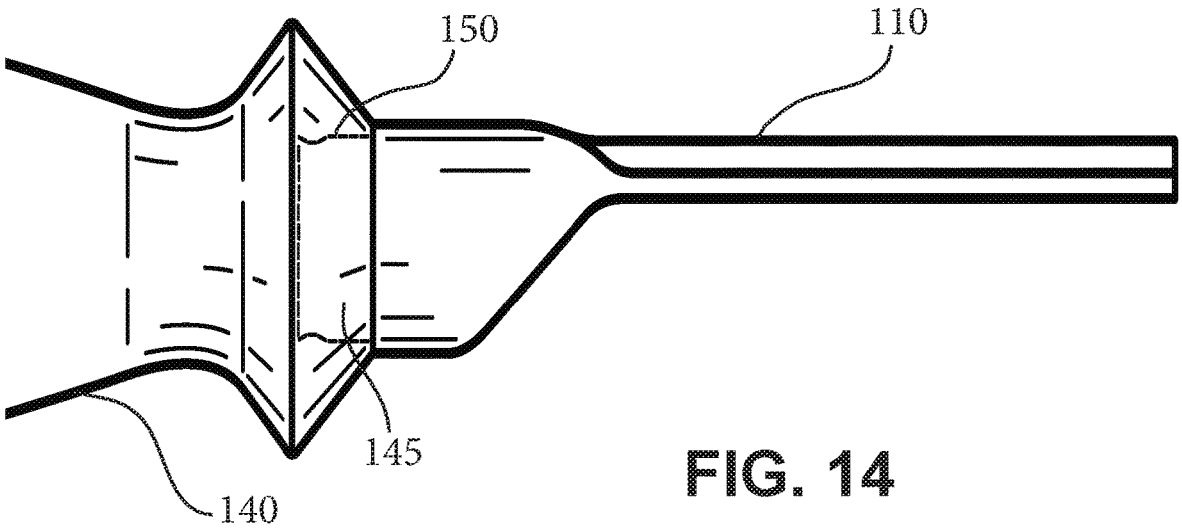
FIG. 14 shows a side view of a portion of an efficient cuticle tool having a removable cuticle-pusher, according to an embodiment of the present invention.

Referring now to FIGS. 13-14, side views of a portion of an efficient cuticle tool having a removable wide cuticle-pusher 112 (FIG. 13) and a narrow cuticle pusher (FIG. 14) are illustratively depicted, in accordance with various embodiments of the present invention.

According to the embodiments shown in FIGS. 13-14, the cuticle pushers 110, 112 include a protrusion 145 configured to be inserted into a receiving portion 150 of the handle 140. According to an embodiment, the protrusion 145 is removable from the receiving portion 150, thus enabling the cuticle pusher 110, 112 to be removed from the handle 140. It is noted, however, that other cosmetic devices, such as, e.g., the cuticle cleaner 120, may alternatively be coupled to the protrusion 145, enabling it to be removed from the handle 140.

Figure 15:
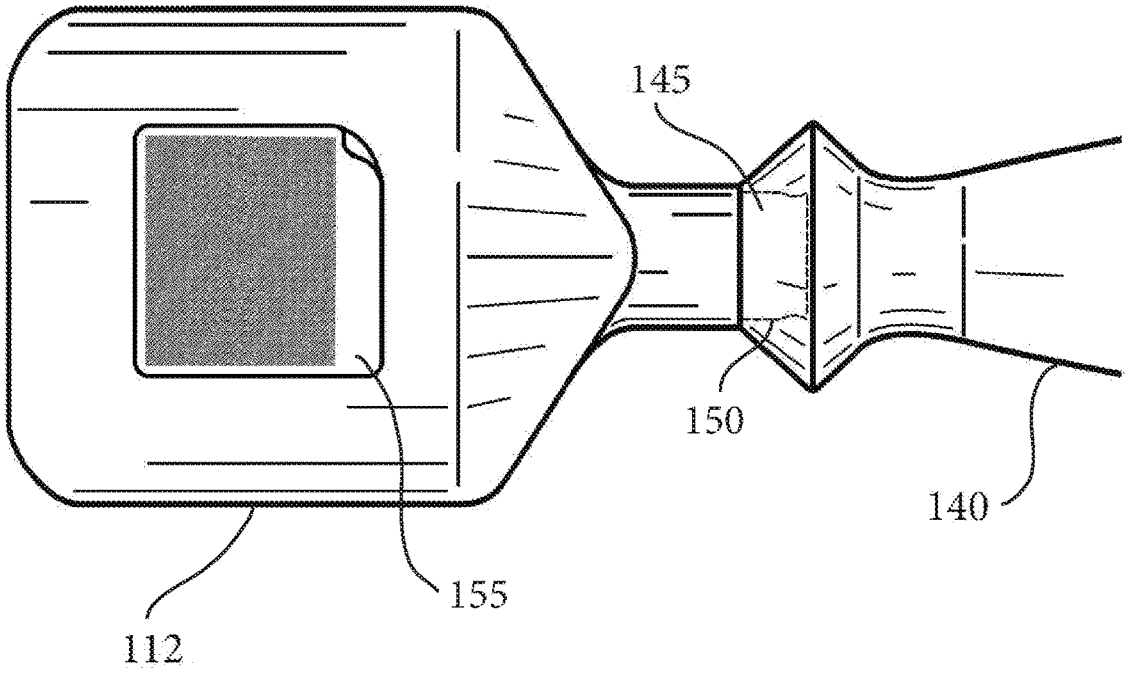
FIG. 15 shows a side view of a portion of an efficient cuticle tool having a removable cuticle buffer, according to an embodiment of the present invention.

Referring now to FIG. 15, a side view of a portion of an efficient cuticle tool having a removable cuticle buffer 155 is illustratively depicted, in accordance with an embodiment of the present invention.

According to various embodiments of the present invention, one or more portions of the efficient cuticle tool may include the removable cuticle buffer 155, which may be placed and/or removed from one or more locations on the efficient cuticle tool.

According to any of the embodiments, the cuticle pusher 110, 112 and/or the cuticle cleaner 120 may include a cuticle buffer 130 incorporated and/or etched therein.

According to any of the embodiments, the efficient cuticle tool may include metal and/or plastic and may be disposable or reusable. According to an embodiment, the cuticle pusher 110, 112 and/or the cuticle cleaner 120 include a material different from the handle 140 portion. According to an embodiment, the cuticle pusher 110, 112 and/or the cuticle cleaner 120 include a material included in the handle portion 140.

The efficient cuticle tools described herein provide a cosmetic cuticle apparatus that removes and/or cleans a cuticle without the use of scissors or cuticle clippers, thereby making the removal of cuticles easier.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A cosmetic cuticle apparatus, comprising:

an elongated handle portion having a circular cross-section, a first end, and a second end, wherein the elongated handle portion has a cross-sectional thickness that is greater at a middle portion of the elongated handle portion than at either the first end or the second end, wherein the elongated handle flares outward at each of the first end and the second end to a flared edge from a central point of the elongated handle, and wherein a frustoconical portion is formed from the flared edge to a terminal portion at each of the first end and the second end, the frustoconical portion forming a receptacle on each of the first end and the second end of the handle portion;

a cuticle buffer coupled to the receptacle at the first end of the elongated handle portion, wherein the cuticle buffer comprises a top surface and an arcuate periphery, and wherein a width of the top surface of the cuticle buffer is less than a width of the arcuate periphery of the cuticle buffer; and a "V"-shaped cuticle cleaner having a pointed top and a "V"-shaped cross-section, the "V"-shaped cuticle cleaner being coupled to the receptacle at the second end of the elongated handle portion.

2. The cosmetic cuticle apparatus of claim 1, wherein the receptacle further comprises a recess.

3. The cosmetic cuticle apparatus of claim 2, wherein the recess has threading on a surface thereof.

4. The cosmetic cuticle apparatus of claim 1, wherein the cuticle buffer, the "V"-shaped cuticle cleaner, and the elongated handle portion are a singular structure.

5. A cosmetic cuticle apparatus, consisting of:

an elongated handle having a circular cross-section, a first end, and a second end, wherein the elongated handle has a thickness that is greater at a middle portion of the elongated handle than at either the first end or the second end, wherein the elongated handle flares outward from a central point of the elongated handle forming a flared edge at each of the first end and the second end, and wherein a frustoconical portion is formed from the flared edge to a terminal portion of each of the first end and the second end thereby forming a receptacle on each of the first end and the second end;

a cuticle buffer coupled to the receptacle at the first end of the elongated handle, wherein the cuticle buffer has a top surface and an arcuate periphery, and wherein a width of the top surface is less than a width of the arcuate periphery of the cuticle buffer;

and a "V"-shaped cuticle cleaner having a pointed top and a "V"-shaped cross-section, the "V"-shaped cuticle cleaner being coupled to the receptacle at the second end of the elongated handle.

6. The apparatus of claim 5, wherein the cuticle buffer and the "V"-shaped cuticle cleaner are threadably coupled to the elongated handle.

7. The apparatus of claim 6, wherein the cuticle buffer and the "V"-shaped cuticle cleaner are removably coupled by threading to the elongated handle.

8. The apparatus of claim 6, wherein the pointed top of the "V"-shaped cuticle cleaner is oriented to align with a top side of the elongated handle.

9. The apparatus of claim 6, wherein an underside of the cuticle buffer is flat.

10. The apparatus of claim 6, wherein the cuticle buffer has a sloped surface coupling the arcuate periphery to the top surface.

11. The apparatus of claim 5, wherein the receptacle comprises a recess.

* * * * *